US006370700B1

(12) United States Patent
Arion

(10) Patent No.: US 6,370,700 B1
(45) Date of Patent: Apr. 16, 2002

(54) DEVICE FOR ACTUATING A HELMET VISOR

(76) Inventor: Jean-Claude Arion, Parc Haute Technologie-694 Avenue Dr. Maurice Donat, 06250 Mougins (FR)

( * ) Notice: Subject to any disclaimer, the term of this patent is extended or adjusted under 35 U.S.C. 154(b) by 0 days.

(21) Appl. No.: 09/622,944

(22) PCT Filed: Feb. 26, 1999

(86) PCT No.: PCT/FR99/00436

§ 371 Date: Aug. 24, 2000

§ 102(e) Date: Aug. 24, 2000

(87) PCT Pub. No.: WO99/43226

PCT Pub. Date: Feb. 9, 1999

(30) Foreign Application Priority Data

Feb. 27, 1998 (FR) ..... 98 02410

(51) Int. Cl.[7] ..... A42B 3/22
(52) U.S. Cl. ..... 2/424; 340/825.19
(58) Field of Search ..... 2/424, 8, 9, 10, 2/425, 422, 410, 6.3, 6.4, 6.5, 6.7; 340/825.19; 455/344

(56) References Cited

U.S. PATENT DOCUMENTS 3,540,058 A 11/1970 Aucun
4,130,803 A * 12/1978 Thompson ..... 455/344
5,212,476 A * 5/1993 Maloney ..... 340/825.19 X
5,297,297 A * 3/1994 Pei ..... 2/424
5,460,186 A * 10/1995 Buchhold ..... 340/825.19 X

FOREIGN PATENT DOCUMENTS

| | | |
|---|---|---|
| CH | 660956 | 6/1987 |
| EP | 0487027 | 5/1992 |
| EP | 0734704 | 10/1996 |
| FR | 2153395 | 5/1973 |
| FR | 2438229 | 4/1980 |
| FR | 2471153 | 6/1981 |
| GB | 2014432 | 8/1979 |

* cited by examiner

*Primary Examiner*—Peter Nerbun
(74) *Attorney, Agent, or Firm*—Weingarten, Schurgin, Gagnebin & Lebovici LLP

(57) ABSTRACT

A system is provided for actuating an integral helmet visor with elements for protecting the lower part of the face. The system includes a motoring system powered by an electronic source for moving the visor between an opening position and a closing position and an electronic control circuit internal to the helmet and associated with the motoring system. The control circuit is capable of being actuated by electrically connecting part of the face or the tongue with at least an electrode connected to the control circuit.

14 Claims, 3 Drawing Sheets

DEVICE FOR ACTUATING A HELMET VISOR

BACKGROUND OF THE INVENTION

The present invention relates to a device allowing actuation of the visor of an integral helmet via a mobile part of the face or the tongue.

An integral helmet generally presents an element for protecting the lower part of the face defining an opening capable of being obturated by a manually displaceable visor.

This arrangement obliges the motorcyclist to let go the handlebar of the motorbike with one hand and to recognize, blind, a mark or the edge of this visor in order to raise or lower it.

Known solutions consist in motorized systems on racks or the like, powered by a source and enabling the visor to be displaced. Such systems are actuated by controls comprising either an electrical contact on the helmet itself, which, in the same way, involves putting one's hand on the helmet, or a remote contact with a wire, or, finally, a contact with the handlebar with a remote control.

However, this latter solution, which is best adapted, requires a system outside the helmet powered by another electric source.

Controls of the type described in U.S. Pat. No. 5,297,297 also exist, which are activated by the helmet wearer's breath and which comprise an electric switch of which the first pole is formed by a fixed contactor and the second pole is constituted by a conducting plate borne by the free end of a helical spring.

The plate is mounted behind a network of orifices and perpendicularly to the flow of air blown by the wearer and capable of passing through these orifices.

The pressure resulting from the helmet wearer's breath is used for displacing the plate which then touches the contactor, closing the electric circuit.

However, with this device, it is not easy to ensure electrical contact between the plate and the contactor for a duration corresponding to the rising or descending stroke of the visor, since this requires blowing for a fairly long period.

In addition, blowing must be precise in order to concentrate on the plate and sufficiently powerful to overcome the resistance of the spring, this also necessitating a considerable physical effort of the helmet wearer. Under these conditions, reliability of this control is very poor.

SUMMARY OF THE INVENTION

The system according to the invention makes it possible to solve the above-described technical problems satisfactorily.

This purpose is attained by means of a system for actuating an integral helmet visor, characterized in that it comprises, on the one hand, a motoring system powered by an electric source for moving said visor between an opening position and a closing position, and, on the other hand, an electronic control circuit internal to the helmet and associated with said motoring system and capable of being activated by electrical connection of part of the face or of the tongue with at least one electrode connected to said circuit.

According to a first embodiment, the system comprises at least two high-impedance and low-current electrodes, capable of being short-circuited by direct contact with the tongue.

The system preferably comprises a right-hand electrode, a left-hand electrode and a central electrode connected to the ground of the circuit.

According to another embodiment, the system comprises at least one free electrode connected, on the one hand, to a capacitor of the control circuit and intended to be connected, on the one hand, to a mobile part of the face or to the tongue by direct electrical contact or electrostatic influence by producing a capacitive effect.

The system preferably comprises two free electrodes corresponding respectively to the rise and descent of the visor.

According to an advantageous characteristic, said control circuit is connected to the motoring system via inverter CMOS amplifiers in series and transistors mounted in bridge form.

According to an advantageous characteristic, the electric source is integrated in the material lining of the helmet.

According to another characteristic, said electrode is disposed in the protecting element opposite the mouth.

Thus, control is effected by a mobile part of the face or the tongue. By way of non-limiting example, control is therefore activated by two right and left, high-impedance and low-current electrodes short-circuited for the opening and closure of the visor or two right and left, capacitor effect electrodes for the opening or closing of the visor.

By way of non-limiting example, the electronic circuit may be mounted on the input of inverter CMOS amplifiers in series, saturating, or one of the other of two transistors mounted in bridge form.

The assembly of the batteries forming the electric source is buried in the foam of the helmet.

BRIEF DESCRIPTION OF THE SEVERAL VIEWS OF THE DRAWING

The invention will be more readily understood on reading the following description with reference to the accompanying drawings, in which.

DETAILED DESCRIPTION OF THE INVENTION

Figure 1:
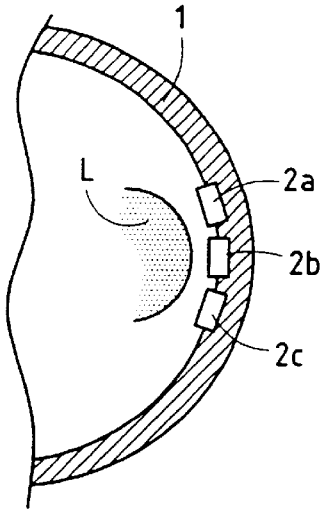
FIG. 1 shows a view in horizontal section at the level of the chin-protecting element of an integral helmet equipped with a first embodiment of the device of the invention.
Figure 2:
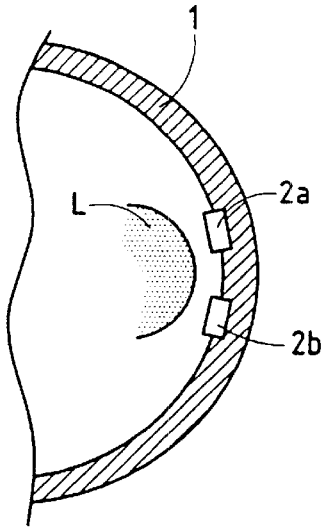
FIG. 2 shows a view in horizontal section at the level of the chin element of an integral helmet equipped with a second embodiment of the device of the invention.

The helmet shown in FIGS. 1 and 2 is an integral helmet provided on the front with an element 1 for protecting the lower part of the face and in particular the chin.

Figure 5:
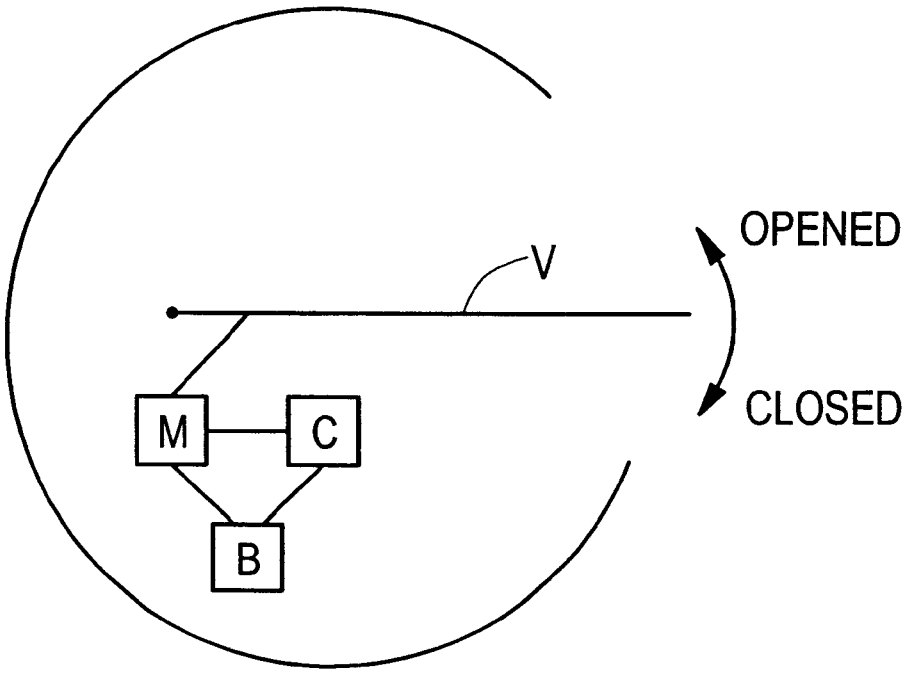
FIG. 5 shows a representation of the movement of a visor between an upper position of opening and a lower position of closure of a window by a motoring system coupled to a control circuit and powered by an electric source.

The protecting element 1 is constituted by a curvilinear section generally disposed at a short distance from the mouth and downwardly defining an opening or window capable of being obturated by a visor V as shown in FIG. 5.

The system of the invention is intended to actuate this visor V.

To that end, the system includes a motoring system M powered by an electric source (battery, batteries . . . ) B (cf.

Figure 3:
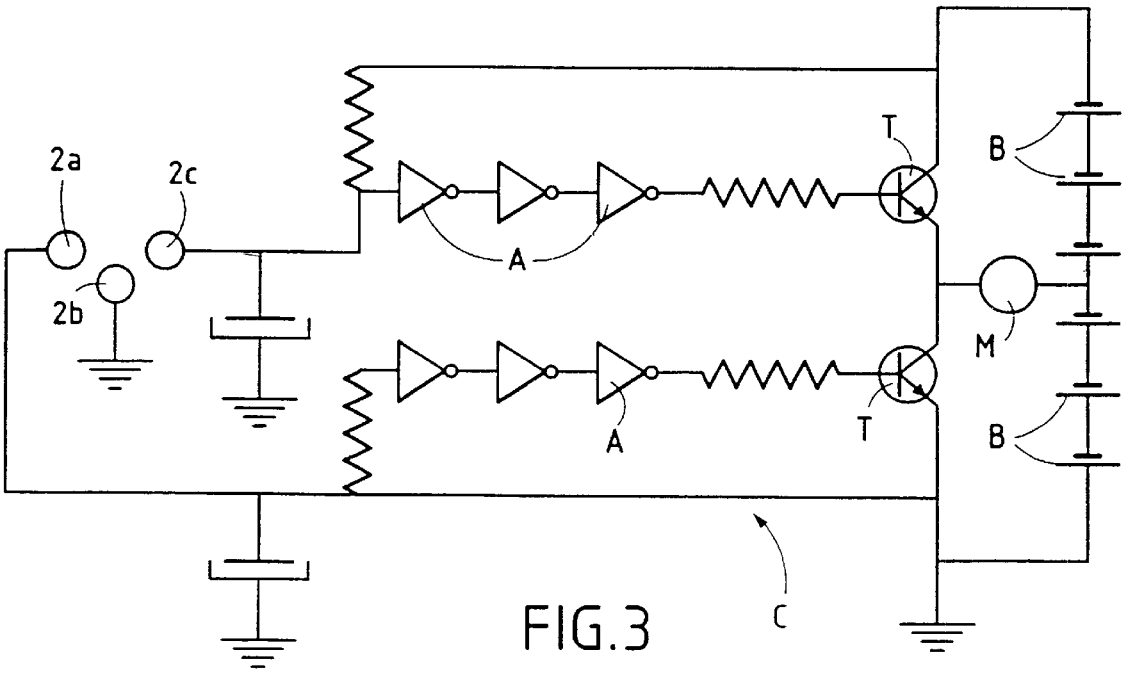
FIG. 3 shows an electronic control circuit capable of being used for the first embodiment of the device of the invention.

FIG. 3) making it possible to move the visor V between an upper position of opening and a lower position of closure of the window.

The system of the invention is intended to actuate this visor.

To that end, the system includes a motoring system M powered by an electric source (battery, batteries . . . ) B (cf. FIG. 3) making it possible to move the visor between an upper position of opening and a lower position of closure of the window.

The motoring system M and the electric source B are integrated in the lining material (foam . . . ) of the rigid shell forming the structure of the helmet and are therefore not visible, this preserving the overall aesthetic appearance.

The motoring system M is coupled to an electronic control circuit C likewise mounted inside the envelope of the helmet.

The control circuit C is activated by electrical connection of a mobile part of the face (chin, lips . . . ) or of the tongue with at least one electrode 2, connected to said circuit and disposed in the protection element 1 located opposite the mouth.

In the embodiment of FIG. 1, the device of the invention comprises three high-impedance and low-current electrodes 2*a*, 2*b*, 2*c*. the end electrodes 2*a*, 2*c* are thus capable of being short-circuited by direct contact, for example with the helmet wearer's tongue L, while the central electrode 2*b* is connected to the ground of the circuit.

These three electrodes are electrically connected to an electronic circuit C of the type shown in FIG. 3, where connection to the motoring system M is effected via inverter CMOS amplifiers A in series and transistors T mounted in bridge form.

Closure of the circuit C brings about supply of the motoring system M and displacement of the visor by causing a very low direct current to pass via the tissues of the tongue.

In the embodiment of FIG. 2, the system comprises at least one, and here two, free electrodes 2*a*, 2*b* each connected, on the one hand, to a capacitor K of the control circuit C and intended to be connected, on the other hand, to a mobile part of the face or to the tongue L by direct electrical contact or electrostatic influence by producing a capacitive effect. The two electrodes 2*a*, 2*b* correspond respectively to the rise and descent of the visor of the helmet.

In that case , the electrode is so-called "in the air " and the capacitor K does not deliver any current in the absence of any electrical coupling of the electrode with another conducting element.

Any insulated conducting mass such as that of the human body can be considered as a reservoir of electrons capable of ensuring, by contact with an electrode which is in the air and even by simple electrostatic "influence", a leakage of current through the capacitor to which this mass is connected.

If the capacitor is supplied with alternating current (about 100 kilohertz for usual applications), this current can be transformed by rectification into direct current and the actuation device of the invention can thus be made to operate.

Figure 4A:
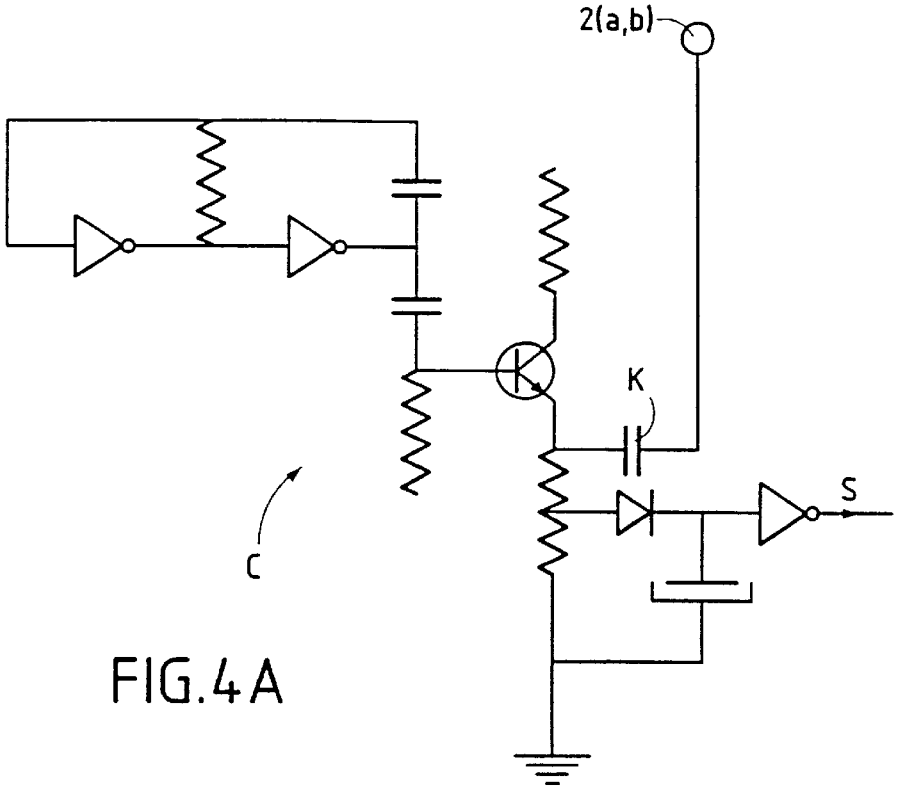
FIGS. 4A and 4B show two variants of a part of an electronic control circuit capable of being used for the second embodiment of the device of the invention.
Figure 4B:
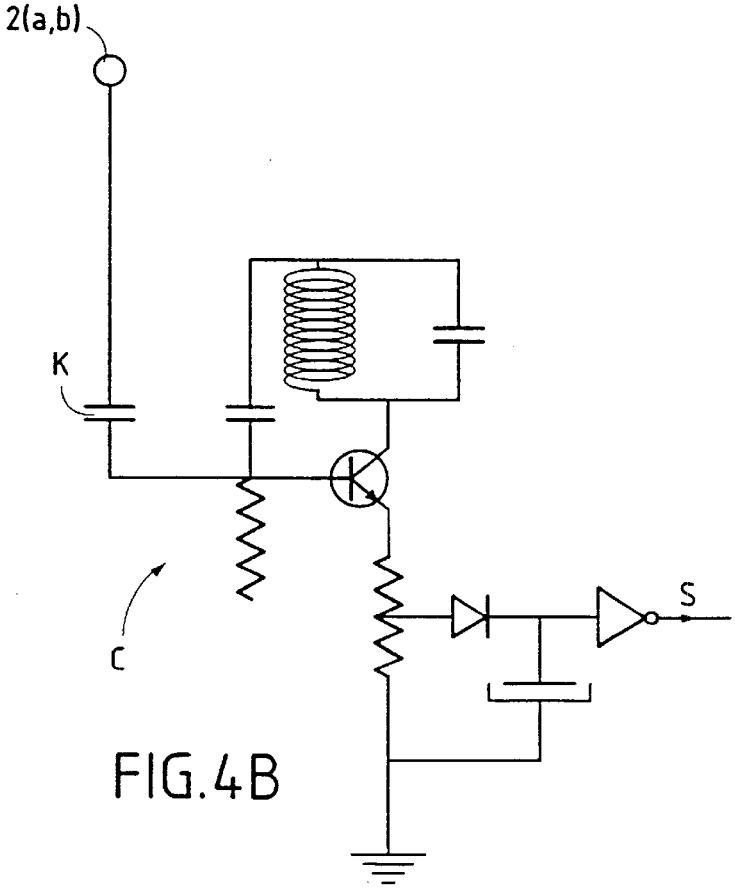

FIGS. 4A and 4B show two variant electronic assemblies intended to be used in a control circuit in capacitive mode.

These assemblies use a passage of current through a capacitor K and generate a continuous signal S translating the leakage of current. This signal S is then processed by a complementary electronic assembly equivalent to that of FIG. 3.

The assembly of FIG. 4*b* uses the principle of the critical mismatching of an oscillating circuit.

The motoring system M is triggered by the damping of an oscillation due to a change of frequency of the alternating current.

This frequency change is generated by connection to the oscillating circuit of an additional electric capacitor formed here by the human body.

It will be apparent to those skilled in the art that other modifications to and variations of the above-described techniques are possible without departing from the inventive concepts disclosed herein. Accordingly, the invention should be viewed as limited solely by the scope and spirit of the appended claims.

What is claimed is:

1. A system for actuating an integral helmet visor of a helmet comprising:

a motoring system powered by an electric source for moving said helmet visor between an opening position and a closing position;

a control circuit internal to the helmet and associated with said motoring system; and a sensor for sensing contact by a part of the face or of the tongue having at least one electrode connected to said control circuit and activating said control circuit responsive to sensing an electrical signal from said electrode after contact by part of the face or of the tongue by said sensor for triggering said helmet visor to be placed in the opposite of said opening or closing position.

2. A system according to claim 1, wherein said sensor comprises at least two high-impedance and low-current electrodes, which are short-circuited by direct contact with part of the face or the tongue.

3. A system according to claim 1, wherein said sensor comprises a right-hand electrode, a left-hand electrode and a central electrode connected to the ground of the control circuit.

4. A system according to claim 1, wherein said sensor comprises at least one free electrode connected to a capacitor of the control circuit and to a mobile part of the face or to the tongue by direct electrical contact or electrostatic influence by producing a capacitive effect.

5. A system according to claim 1, wherein said sensor comprises two free electrodes corresponding respectively to the rise and descent of the visor.

6. A system according to claim 1, wherein said control circuit is connected to the motoring system via inverter CMOS amplifiers in series and transistors mounted in a bridge form.

7. A system according to claim 1, wherein the electric source is integrated in the material lining of the helmet.

8. A system according to claim 1, wherein said sensor comprises at least one electrode adapted to be disposed opposite the mouth on a protecting element connected to the helmet for protecting the lower part of the face.

9. A system according to claim 1, wherein said sensor comprises a right-hand electrode, a left-hand electrode and a central electrode connected to the ground of the control circuit;

said control circuit is connected to the motoring system via inverter CMOS amplifiers in series and transistors mounted in bridge form; and the electric source is integrated in the material lining of the helmet.

10. A system according to claim 1, wherein said sensor comprises at least one free electrode connected to a capacitor of the control circuit and to a mobile part of the face or to the tongue by direct electrical contact or electrostatic influence by producing a capacitive effect, and two free electrodes corresponding respectively to the rise and descent of the visor.

11. A system according to claim 9, wherein said sensor comprises one of said electrodes adapted to be disposed opposite the mouth on a protecting element connected to the helmet for protecting the lower part of the face.

12. A system according to claim 10, wherein said sensor comprises at least one free electrode adapted to be disposed opposite the mouth on a protecting element connected to the helmet for protecting the lower part of the face.

13. A system according to claim 1, wherein said sensor senses contact by the chin.

14. A system according to claim 1, wherein said sensor senses contact by the lips.

* * * * *

UNITED STATES PATENT AND TRADEMARK OFFICE

CERTIFICATE OF CORRECTION

PATENT NO. : 6,370,700 B1
DATED : April 16, 2002
INVENTOR(S) : Jean-Claude Arion It is certified that error appears in the above-identified patent and that said Letters Patent is hereby corrected as shown below:

Title page,
Item [87], PCT Pub. Date, "Feb. 9, 1999" should read -- Sept. 2, 1999 --.

Column 3,
Lines 4-10, please delete the following:
"The system of the invention is intended to actuate this visor.
To that end, the system includes a motoring system M powered by an electric source (batter, batteries...) B (cf. FIG. 3) making it possible to move the visor between an upper position of opening and lower position of closure of the window."

Signed and Sealed this

Twenty-fifth Day of February, 2003

JAMES E. ROGAN
*Director of the United States Patent and Trademark Office*